US006394256B2

(12) United States Patent
Mukai

(10) Patent No.: US 6,394,256 B2
(45) Date of Patent: May 28, 2002

(54) PAPER DISCRIMINATING APPARATUS

(75) Inventor: Masanori Mukai, Kawasaki (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/060,148

(22) Filed: Apr. 15, 1998

(30) Foreign Application Priority Data

Dec. 11, 1997 (JP) ..... 9-341514

(51) Int. Cl.[7] ..... G07D 7/12
(52) U.S. Cl. ..... 194/207; 382/135
(58) Field of Search ..... 194/206, 207; 250/556; 382/135; 356/71

(56) References Cited

U.S. PATENT DOCUMENTS 4,255,057 A * 3/1981 Williams ..... 356/435
4,435,834 A * 3/1984 Pauli et al. ..... 194/206 X
4,442,541 A * 4/1984 Finkel et al. ..... 209/534 X
4,592,090 A * 5/1986 Curl et al. ..... 209/534 X
5,055,834 A * 10/1991 Chiba ..... 340/825.34
5,199,543 A * 4/1993 Kamagami et al. ..... 194/207
5,391,889 A * 2/1995 Nishijima ..... 250/556 X
5,607,040 A * 3/1997 Mathurin ..... 194/207

FOREIGN PATENT DOCUMENTS

EP 0078708 * 5/1983 ..... 194/207

* cited by examiner

*Primary Examiner*—F. J. Bartuska
(74) *Attorney, Agent, or Firm*—Staas & Halsey LLP

(57) ABSTRACT

A paper discriminating apparatus is capable of discriminating different number bills. A paper, in which character strings inherent for each sheet are recorded on a plurality of character areas, is detected so that the paper is discriminated in accordance with image data obtained by detection of the paper. The paper discriminating apparatus has a character sensor for reading the plurality of character areas of the paper in form of an image, a character recognition unit for recognizing the character strings recorded on the plurality of character areas in the accordance with image data obtained by the character sensor, and a character decision unit for deciding a coincidence between the character strings recorded on the plurality of character areas.

6 Claims, 6 Drawing Sheets

PAPER DISCRIMINATING APPARATUS

BACKGROUND OF THE INVENTION

1. Field of the Invention

The present invention relates to a paper discriminating apparatus for discriminating papers such as paper moneys, and more particularly, to an apparatus for discriminating paper moneys, which is incorporated into an automatic teller machine (hereinafter, referred to as an ATM) for executing transactions such as receipt of money, payment, etc.

2. Description of the Related Art

Hitherto there is widely used an ATM for executing transactions such as receipt of money, and payment, through an operation of a user, sorting out received paper moneys for each sort of money, and excluding false bills. Such an ATM incorporates thereinto, for example, such a function that a paper money is detected in its entirety to obtain image data and the paper money is discriminated on the basis of the general aspect of the paper indicated by the image data thus obtained.

By the way, with respect to paper moneys, it is usual that the inherent money number for each paper money is printed at two places on each paper money. Thus, for example, dividing each of two true bills into the halves and combining the respective different halves makes it possible to form a so-called different number bill having two different paper money numbers. It is prohibited by a that such a different number bill is exchanged for a true bill. However, according to the function of discriminating paper moneys, which is incorporated into the conventional ATM, it is impossible to distinguish the different number bill from a true bill, since it is regarded as a true bill if the general aspect of paper moneys is decided as no problem in a certain range, so that the different number bill is recognized as a true bill. And thus there is a problem that the different number bill may be exchanged for a true bill. This type of problem may be involved in various sorts of paper moneys in which the inherent character string is recorded at a plurality of places on each paper money. Hereinafter, a paper having two different inherent character strings is referred to as a "different number bill" in a similar fashion to that of paper moneys.

SUMMARY OF THE INVENTION

In view of the foregoing, it is therefore an object of the present invention to provide a paper discriminating apparatus capable of distinguishing a different number bill from a true bill.

To accomplish the above-mentioned object, according to the present invention, there is provided a paper discriminating apparatus wherein a paper, in which character strings inherent for each sheet are recorded on a plurality of character areas, is detected so that the paper is discriminated in accordance with image data obtained by detection of the paper. The discriminating apparatus comprises the following:

- a character sensor for reading the plurality of character areas of the paper in the form of an image;
- a character recognition unit for recognizing the character strings recorded on the plurality of character areas in accordance with image data obtained by said character sensor; and
- a character decision unit for deciding a coincidence between the character strings recorded on the plurality of character areas, said character strings being recognized by said character recognition unit.

In the above-mentioned paper discriminating apparatus, it is preferable that said character decision unit decides whether the character strings recorded on the plurality of character areas, said character strings being recognized by said character recognition unit, are character strings in which mutually same characters are arranged in mutually same sequence.

According to the paper discriminating apparatus of the present invention, an identity of a plurality of character strings recorded on a plurality of character areas on a paper are decided, thereby removing the different number bills.

In the above-mentioned paper discriminating apparatus, it is preferable that the paper discriminating apparatus further comprises an image sensor for detecting a full range of a paper to obtain image data for the paper, said image sensor being lower in resolution than said character sensor.

For example, as to a sensor for obtaining image data to do a decision of a sort of paper moneys and a decision of authenticity of paper moneys, it is preferable that such a sensor has a low resolution to such an extent that a difference between paper money numbers involves no variation. On the other hand, as to a sensor for obtaining image data to do a recognition of characters, it is necessary that such a sensor has a high resolution to such an extent that a difference between paper money numbers can be discriminated in the form of an image.

The sensor having a high resolution is expensive as compared with the sensor having a low resolution. Thus, in order to contribute to the low cost, it is desirable that the sensor having a high resolution is reduced in size as much as possible.

Generally, in the event that the inherent character string is recorded on a paper, the character area at which the character string is recorded is part which is a determined in position beforehand on the paper.

For the reasons mentioned above, it is preferable that the inexpensive image sensor, which is low in resolution, is used to obtain image data on an entire paper so that decisions, except a decision as to whether it is a different number bill, are performed in accordance with the image data thus obtained. With respect to the decision as to whether it is a different number bill, since a high resolution is required, the character sensor having a high resolution is used to obtain image data on that particular occasion for the character area. This feature permits that a size of the character sensor is reduced approximately to a size of the character area, and thus it is possible to implement the paper discriminating apparatus of the present invention at a relatively low cost.

In the above-mentioned paper discriminating apparatus, it is preferable that the paper discriminating apparatus further comprises an image sensor for detecting a full range of a paper to obtain image data for the paper, and a paper discrimination unit for discriminating a sort of paper in accordance with the image data obtained by said image sensor, wherein said character recognition unit recognizes a character recorded on character areas according to the sort of paper decided in said paper discrimination unit.

According to the paper discriminating apparatus as mentioned above, for example, as in paper moneys, even in the event that there exist a plurality of sorts of moneys, and positions of character areas are different from one another on each sort of money, the paper discrimination unit decides the sort of paper, and the character recognition unit recognizes the character string in accordance with the sort of paper. This feature makes it possible to remove different number bills on each of a plurality of sorts of papers.

DESCRIPTION OF THE PREFERRED EMBODIMENTS

Hereinafter, there will be described embodiments of the present invention.

Figure 1:
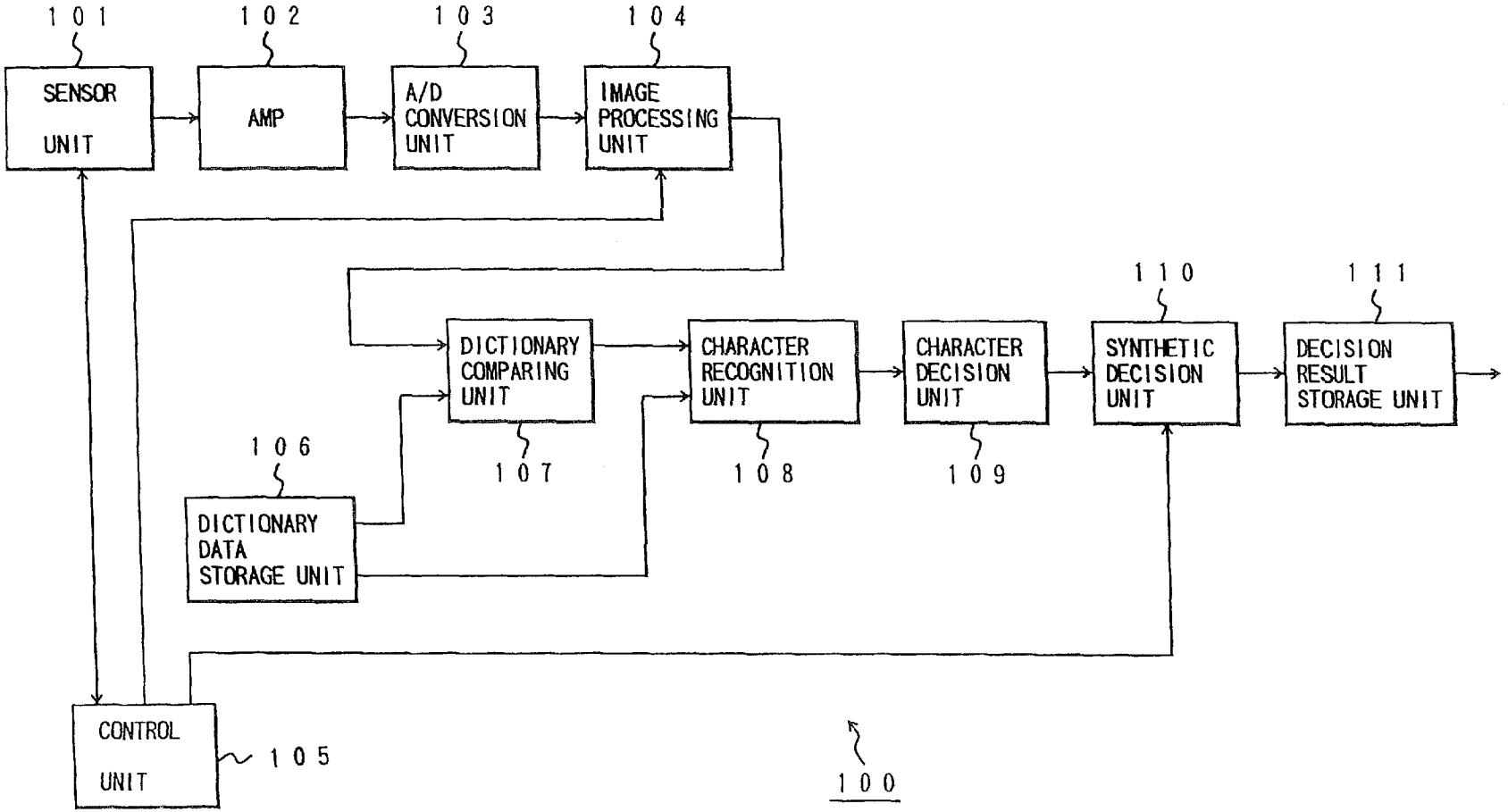
FIG. 1 is a block diagram of a paper discriminating apparatus according to an embodiment of the present invention.

FIG. 1 is a block diagram of a paper discriminating apparatus according to an embodiment of the present invention.

A paper discriminating apparatus 100, which is incorporated into an ATM, performs discrimination among a plurality of sorts of paper money that travele inside the ATM. The ATM performs sorting of paper moneys in accordance with a result of discrimination for paper moneys by the paper discriminating apparatus 100. On paper money, there exist two character areas at positions according to a sort of the paper money, and the inherent paper money number (including character) for the paper money, which is a kind of inherent character string referred to in the present invention, is recorded on the two character areas. As will be described later, the paper discriminating apparatus 100 performs a discrimination for paper moneys in accordance with the inherent paper money number and the like. A mechanism for conveying paper moneys inside the ATM permits a paper money to be conveyed even if the paper money somewhat slants with respect to a traveling direction. Thus, the paper discriminating apparatus 100 is able to discriminate also the paper money traveled at a slant.

The paper discriminating apparatus 100 has a sensor unit 101 for scanning paper moneys to generate image data, an amplifier unit 102 for amplifying the image data generated in the sensor unit 101, an A/D conversion unit 103 for performing an A/D conversion for the image data amplified in the amplifier unit 102, and an image processing unit 104 for processing the image data subjected to the A/D conversion in the A/D conversion unit 103.

Figure 2:
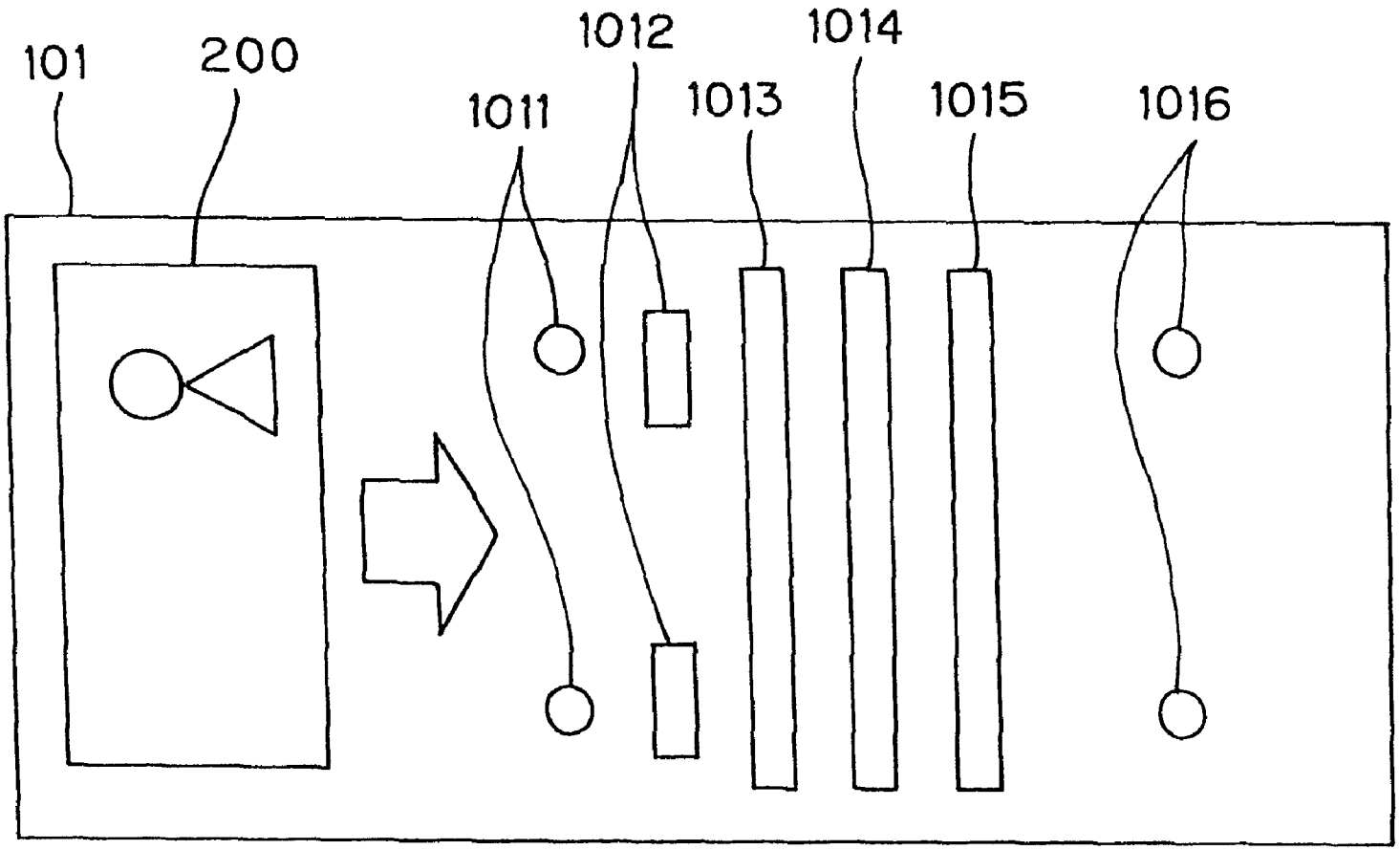
FIG. 2 is a view showing the details of a sensor unit shown in FIG. 1.

FIG. 2 is a view showing the details of the sensor unit shown in FIG. 1.

The sensor unit 101 comprises entry sensors 1011, character sensors 1012, optical line sensors 1013, a magnetic line sensor 1014, a thickness sensor 1015, and passage sensors 1016. The optical line sensor 1013 is an example of the image sensor referred to in the present invention. Paper money 200 is conveyed from the left side of the figure via the sensor unit 101 to the right side of the figure.

Each of the entry sensors 1011 is a type of an optical sensor, and two such entry sensors 1011 are provided. The entry sensors 1011 detect the conveyed paper money 200 to obtain detection information which becomes a signal for a start of a predetermined operation of the paper discriminating apparatus 100. Further, two such entry sensors 1011 individually detect the paper money 200 to determine a slant of the paper money 200 with respect to a traveling direction of the paper money 200 in accordance with a difference between their detected times of the paper money 200.

Figure 3:
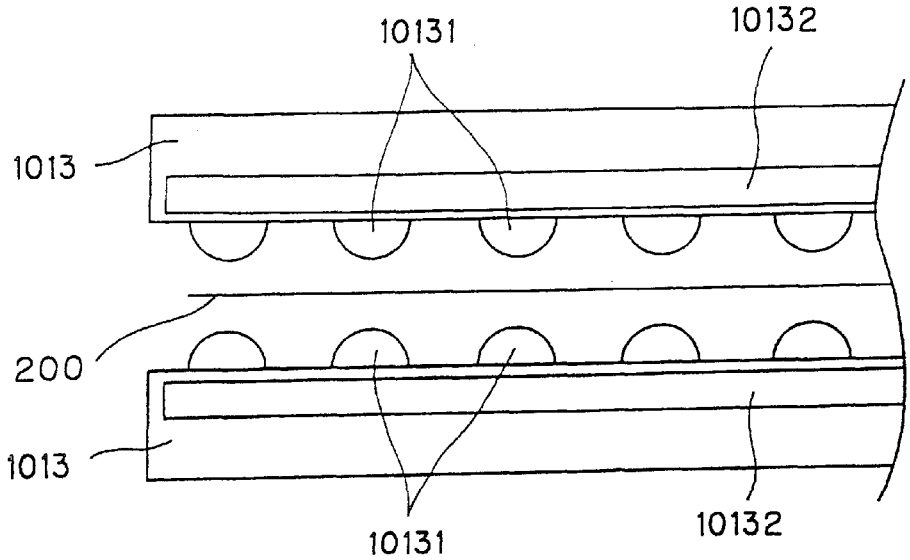
FIG. 3 is an illustration of an optical line sensor.
Figure 4:
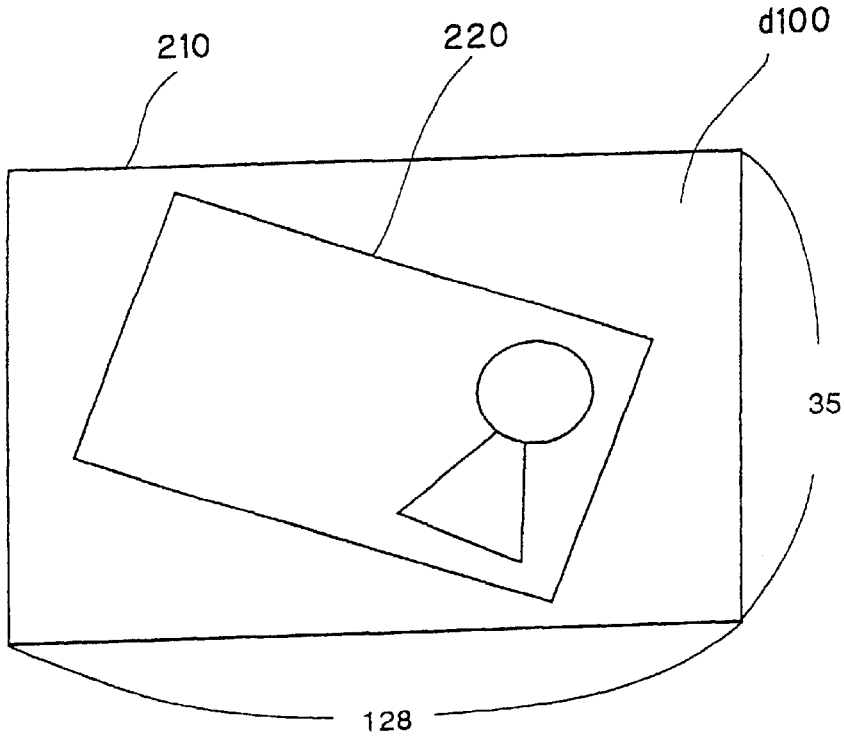
FIG. 4 is a conceptual view showing image data obtained by a line sensor.

As shown in FIG. 3, the optical line sensors 1013 comprise 128 optical sensor device, 10131 arranged in a vertical direction (a right and left direction in FIG. 3) with respect to a traveling direction (a direction vertical to a sheet face of FIG. 3) of the paper money 200. The two optical line sensors 1013 are provided in such a manner that the paper money 200 is sandwiched between the two optical line sensors 1013. After the paper money is detected by the entry sensors 1011, each of the optical sensor devices performs detection 35 times on the paper money at regular intervals. Thus, the paper money 200 is scanned in the traveling direction by the optical sensor devices 10131 constituting the optical line sensors 1013, and as a result, as shown in FIG. 4, there is derived image data d100 representative of a mosaic of 35×128. The image data d100 is image data obtained through a detection of the paper money conveyed at a slant by the line sensors 1013. A range 210 encircled with the most outside of oblong is a range to be scanned by the line sensors 1013. An oblong 220, which is disposed at a slant inside the range 210 to be scanned by the line sensors 1013, denotes an outline of the paper money conveyed at a slant. Thus, a scanning range 210 permitted in scanning by the optical line sensor 1013 is spread to a somewhat broader range than the limit defined by an outline 220. Consequently, even if the paper money 200 is somewhat slantwise conveyed, the paper money 200 is accommodated in the scanning range 210.

As shown in FIG. 3, each of the optical line sensors 1013 is provided with a light emitting device 10132 for applying light to the paper money 200. These light emitting devices 10132 emit light for each time of the above-mentioned 35 times of detection. The light emitting device 10132 shown in the upper side of FIG. 3 is different from the light emitting device 10132 shown in the lower side of FIG. 3 in timing of light emission. While the light emitting device 10132 shown in the upper side of FIG. 3 emits light, the respective optical sensor devices 10131 shown in the upper side of FIG. 3 detect the paper money 200 to generate image data as to a face of the upper side of the paper money 200 shown in FIG. 3 through the reflected light. Simultaneously, while the light emitting device 10132 shown in the upper side of FIG. 3 emits light, the respective optical sensor devices 10131 shown in the lower side of FIG. 3 also detect the paper money 200 to generate image data through the transmitted light. Likewise, while the light emitting device 10132 shown in the lower side of FIG. 3 emits light, the respective optical sensor devices 10131 shown in the lower side of FIG. 3 detect the paper money 200 to generate image data as to a face of the lower side of the paper money 200 shown in FIG. 3 through the reflected light. And simultaneously, while the light emitting device 10132 shown in the lower side of FIG. 3 emits light, the respective optical sensor devices 10131 shown in the upper side of FIG. 3 also detect the paper money 200 to generate image data through the transmitted light. Of the above-mentioned four types of image data, two types of image data due to the transmitted light are added to one another to form a single type of image data.

Figure 5:
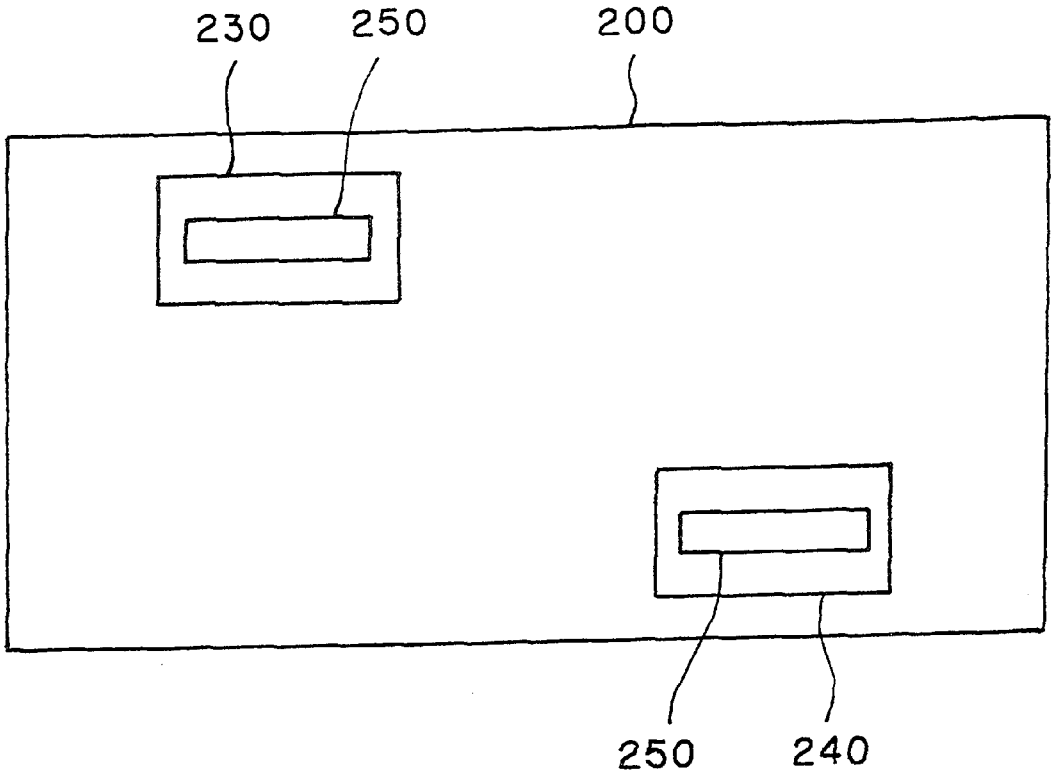
FIG. 5 is an illustration showing the ranges detected by a character sensor.

Next, the character sensors 1012 will be explained. While the optical line sensor 1013 is provided, as shown in FIG. 2, in such a manner that it is associated with the full range of the paper money 200, the character sensors 1012 are provided at two places associated with two character areas, respectively. Further, according to the optical line sensors 1013, there are obtained image data through transmitted light and image data through reflected light. To the contrary, according to the character sensors 1012, there is obtained only image data through reflected light. Resolution of the character sensor 1012 is approximately four times as much as that of the optical line sensor 1013. With respect to other points, the character sensor 1012 is approximately the same as the optical line sensor 1013. As shown in FIG. 5, the ranges to be detected by the character sensor 1012 on the paper money 200 are a range 230 of the left upper side of the paper money 200 and a range 240 of the right lower side of the paper money 200. As mentioned above, there are a plurality of sorts of paper moneys 200. A position of character areas 250 is varied somewhat in accordance with the sort of paper moneys. Further, it happens that the paper money 200 is conveyed at a slant with respect to the conveyance direction. For the reasons described above, the ranges 230 and 240 to be detected by the character sensors 1012 are set up to be ranges somewhat broader than the character areas 250. Hence, even if any sort of paper moneys is conveyed, and also even if the paper money 200 is conveyed at a slant with respect to the conveyance direction, the character areas 250 may be covered by the ranges 230 and 240 to be detected by the character sensors 1012.

Next, the magnetic line sensor 1014 will be explaines. The magnetic line sensor 1014 is substantially the same as the optical line sensor 1013 except that while the optical line sensor 1013 consists of the optical sensor devices being arranged, the magnetic line sensor 1014 consists of the magnetic sensor devices being arranged, and while the optical line sensor 1013 has the light emitting device, the magnetic line sensor 1014 has no device corresponding to the light emitting device. Further, the magnetic line sensor 1014 is of a single different from the optical line sensor 1013. Thus, according to the single magnetic line sensor 1014, there is obtained image data representative of one magnetic image.

The thickness sensor 1015 is for mechanically measuring thickness of the paper money 200 to obtain a conveyance direction distribution of the thickness of the paper money 200.

Each of the passage sensors 1016 is an optical sensor for detecting the paper money 200, and there are provided two pieces of passage sensors 1016 in a similar fashion to that of the entry sensors 1011. A passage velocity as to the passage of the paper money 200 through the sensor unit 101 is determined on the basis of a difference between a time in which the paper money 200 is detected by the entry sensors 1011 and a time in which the paper money 200 is detected by the passage sensors 1016. The passage velocity thus obtained is used for a synthetic decision which will be described hereinafter.

The explanation will be continued returning to FIG. 1.

Referring to FIG. 1, the paper discriminating apparatus 100 has a control unit 105 for controlling the respective units of the paper discriminating apparatus 100. The control unit 105 receives senses information of paper money detected by the entry sensors and the passage sensors of the sensor unit 101. When the entry sensors and the passage sensors detect the paper money, the respective detected time of the paper money is measured by the use of a clock signal generated from a clock circuit not shown, so that the control unit 105 computes a slant of the paper money with respect to the conveyance direction, and a velocity of the paper money passed through the sensor unit 101.

Again referring to FIG. 1, the paper discriminating apparatus 100 has an image processing unit 104. The image processing unit 104 receives via the amplifier unit 102 and the A/D conversion unit 103 image data obtained throughout the full range of the paper money by the optical line sensors of the sensor unit 101, and image data as to the character areas obtained by the character sensors of the sensor unit 101. Those image data are subjected to an image processing which will be described later.

The paper discriminating apparatus 100 further comprises a dictionary data storage unit 106, a dictionary comparing unit 107 and a character recognition unit 108. The dictionary data storage unit 106 stores therein dictionary data associated with the respective image data of the full range of a paper money through reflected light, transmitted light and magnetism, which are standards for discriminating paper moneys, dictionary data associated with the distribution of thickness of a paper money, a character string cut out position table representative of a position of a character area on a paper money according to a sort of moneys, and a character table which serves as standards for recognizing various characters. The contents of the respective tables will be described later. The dictionary comparing unit 107 compares the image data as to the full range of the paper money with the dictionary data stored in the dictionary data storage unit 106 to perform a decision of sort of money and a decision of authenticity as to paper money, and in addition an authenticity decision considering information as to the distribution of the thickness obtained by the thickness sensor. The character recognition unit 108 recognizes a number of a paper money, which is recorded on a plurality of character areas, in accordance with the decision of sort of money by the dictionary comparing unit 107, on the basis of the image data as to the character areas, and the character string cut out position table and a character table which are stored in the dictionary data storage unit 106. A manner of the recognition will be described later.

The paper discriminating apparatus 100 further comprises a character decision unit 109 for deciding an identity of the number of a paper money, which is recorded on a plurality of character areas, recognized by the character recognition unit 108.

The paper discriminating apparatus 100 further comprises a synthetic decision unit 110 and a decision result storage unit 111. The synthetic decision unit 110 decides, as to whether the paper money is to be treated as the true paper money, on the basis of the various decision results by the dictionary comparing unit 107 and the the slant and the passage velocity computed by the control unit 105. A decision result thus obtained is stored in the decision result storage unit 111. The decision result storage unit 111 stores also a decision result as to sort of money, etc. The decision results and the like stored in the decision result storage unit 111 are read out by apparatuses except the paper discriminating apparatus 100, which constitute an ATM, to be utilized for sorting of paper moneys, and the like in the ATM.

A procedure of the discrimination of paper moneys by the above-mentioned paper discriminating apparatus 100 will be described referring to the following flowchart hereinafter.

Figure 6:
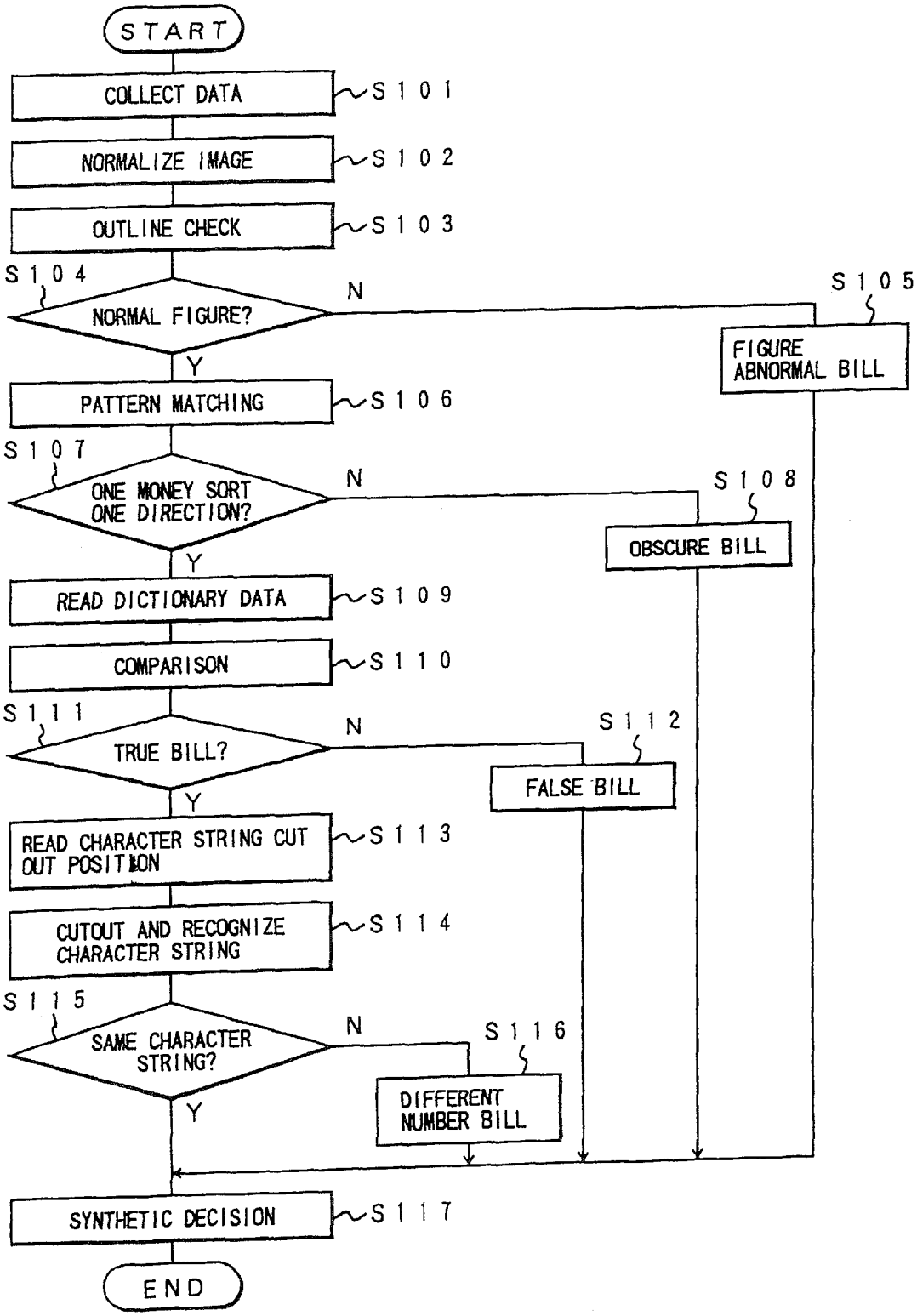
FIG. 6 is a flowchart useful for understanding a procedure for paper moneys.

FIG. 6 is a flowchart useful for understanding a procedure of the discrimination of paper moneys.

When the entry sensors 1011 shown in FIG. 2 detect a paper money, the control unit 105 of the paper discriminating apparatus 100 shown in FIG. 1 instructs a start of the discrimination of paper moneys. First, in a step S101, the respective image data throughout the paper money by reflected light, transmitted light and magnetism, and image data as to the ranges 230 and 240 shown in FIG. 5, including character areas, are collected.

Next, in a step S102, the image processing unit 104 applies the image processing set forth below to the image data collected in the step S102 to normalize those image data.

That is, first, in the image processing unit 104, the computed value as to the slant of the paper money with respect to the conveyance direction, which is received from the control unit 105, is used to practice the slant correction for the respective image data throughout the paper money by reflected light, transmitted light and magnetism, and image data obtained through the character sensors to rotate the paper money so that the paper money is oriented properly. Next, an error due to unevenness in the ink density on paper moneys is corrected. In this manner, the image data are normalized.

After the normalization of the image data as mentioned above, the process goes to a step S103 in which an outline check of,the paper money is performed on the basis of the image data of the full range of the paper money through transmitted light. In the outline check of the paper money, the number of damaged portions of the paper money and the size of the damaged portions are checked to determine a total area of the damaged portions. Thereafter, the process goes to a step S104 in which it is decided whether the total area of the damaged portions is within a numerical limit with which the paper money is regarded as a proper paper money in the figure. In the step S104, when it is decided that the total area of the damaged portions is out of the numerical limit with which the paper money is regarded as a proper paper money in the figure, then the process goes to a step S105 in which the paper money is decided to be an abnormal figure bill and the process goes to a step S117 in which a synthetic decision is made also taking into consideration other decision results and the discrimination processing for the paper money terminates. In the step S104, when it is determined that the total area of the damaged portions is within the numerical limit with which the paper money is regarded as a proper paper money in the figure, the process goes to a step S106.

In the step S106, there is performed a rough pattern matching between the image data of a paper money in its entirety through transmitted light, which has been normalized in the step S102, and the respective dictionary data corresponding to the associated image data of a paper money of each sort of money in its entirety through transmitted light, which has been stored in the dictionary data storage unit 106, and a sort of money for paper moneys and a direction of the paper money are specified. Thereafter, the process goes to a step S107 in which it is determined whether the paper money detected in the sensor unit is specified to a one-direction for a one-sort of money in the step S106. In the event that it is decided that the paper money detected in the sensor unit is not specified to a one-direction for a one-sort of money, the process goes to a step S108 in which it is decided that the paper money is regarded as the obscure bill, and then the process goes to the step S117 in which the synthetic decision is made as mentioned above, and the discrimination processing for the paper money terminates. In the step S107, in the event that the paper money is specified to a one-direction for a one-sort of money, the process goes to a step S109.

In the step S109, as to the sort of money specified in the step S106, dictionary data, which associate with image data through reflected light, image data through transmitted light, image data through magnetism and the thickness distribution, respectively, are read from the dictionary data storage unit 106, and then the process goes to a step S100 in which the respective image data of the full range of the paper money through reflected light, transmitted light and magnetism, and the thickness distribution are compared with the dictionary data for each pixel to obtain a difference between data for every pixel, and the number of pixels in which the difference between data exceeds a predetermined reference value is determined. Thereafter, the process goes to a step Sill in which it is decided whether the number of pixels wherein the difference between data exceeds a predetermined reference value is determined, which is determined in the step S100, is less than a reference pixel number as a standard for discrimination between the true bill and the false bill, and when it is decided that it exceeds the reference pixel number, the process goes to a step S112 in which the paper money is discriminated as the false bill and then the process goes to the step S117 in which the synthetic decision is made as mentioned above, and the discrimination processing for the paper money terminates. In the step S111, when it is decided that the difference between data is less than the reference pixel number, the process goes to a step S113 in which the character recognition unit 108 shown in FIG. 1 reads cut out positions according to the sort of money specified in the step S106, from the character string cut out position table as shown in Table 1, which is stored in the dictionary data storage unit 106.

TABLE 1

| | |
|---|---|
| Sort of money: A | 25 mm - 55 mm from the left |
| First cut out position | 12 mm - 20 mm from the top |
| Sort of money: A | 60 mm - 30 mm from the right |
| Second cut out position | 15 mm - 7 mm from the bottom |
| Sort of money: B | 20 mm - 50 mm from the left |
| First cut out position | 10 mm - 18 mm from the top |
| Sort of money: B | 55 mm - 25 mm from the right |
| Second cut out position | 10 mm - 2 mm from the bottom |

The dictionary data storage unit 106 stores therein the character string cut out position table, as shown in Table 1, which is indicative of the first cut out position and the second cut out position for each one sort of money. In the step S113, two cut out positions according to the sort of money are read from the character string cut out position table, and the process goes to a step S114 in which the character recognition is performed one by one in character in accordance with the data portion associated with the cut out position read in the step S113, of the image data of the character areas, which are normalized in the image processing unit 105.

Figure 7:
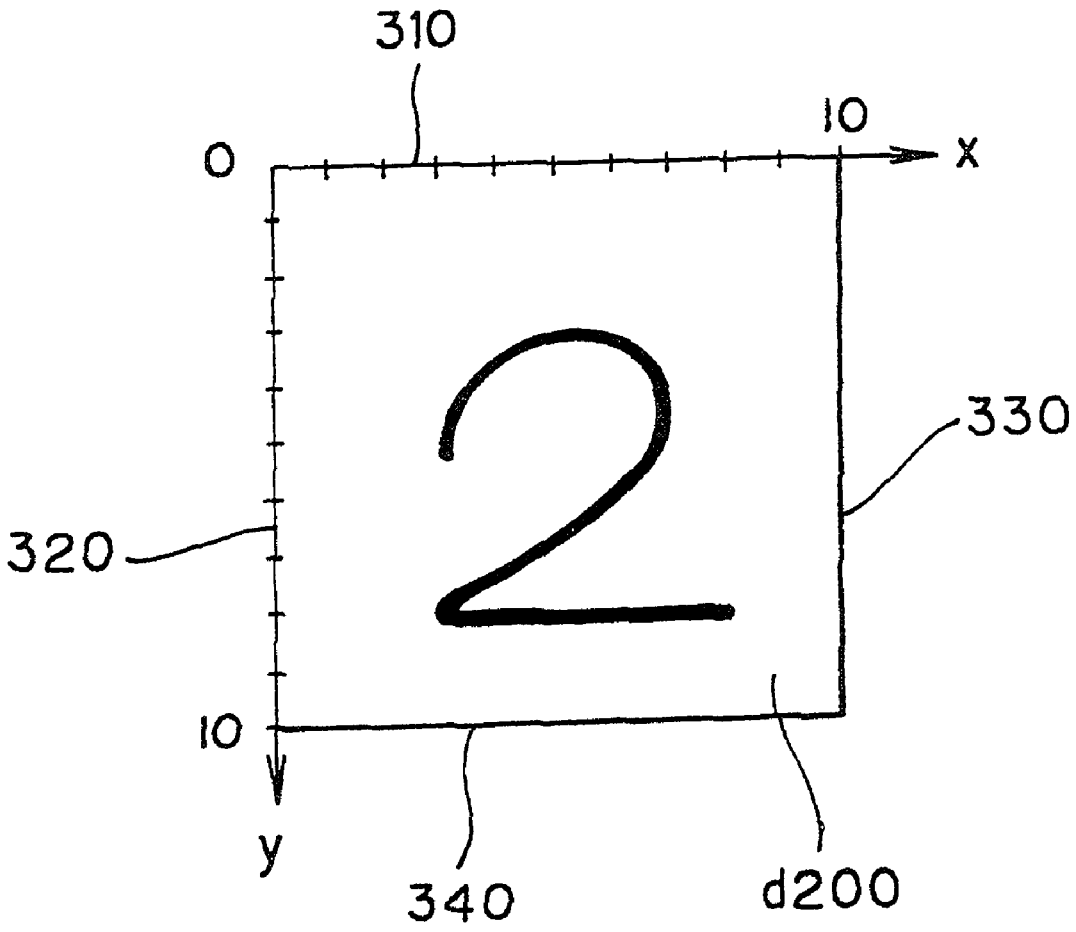
FIG. 7 is a conceptual view showing a character of a data portion according to a cut out position, of image data of character areas.

FIG. 7 is a conceptual view showing a character of data portion according to a cut out position, of image data of character areas.

A character of data portion d200 is representative of a mosaic image of 10 rows×10 columns. FIG. 7 shows by way of example a mosaic image of the character "2". In order to recognize the character represented by the mosaic image of 10 rows×10 columns, first, there is set up a coordinate space for the mosaic image wherein the left upper portion of FIG. 7 is given the origin; the right direction of FIG. 7 the positive direction of x coordinates; and the lower direction of FIG. 7 the positive direction of y coordinates. Next, the mosaic image is scanned from the respective points on an x-axis 310 to a direction in which the y coordinates are increased to determine the respective y coordinates when the scanning reaches part of the character. The y coordinates thus obtained are associated with the x coordinates of the respective points on the x-axis 310, respectively. Thus, there is tabulated a table indicative of the association between the x coordinates and the y coordinates, as shown in the following Table 2.

TABLE 2

| x | 0 | 1 | 2 | 3 | 4 | 5 | 6 | 7 | 8 | 9 | 10 |
|---|---|---|---|---|---|---|---|---|---|---|---|
| y | x | x | x | 5 | 4 | 3 | 4 | 5 | 8 | x | x |

In Table 2, the symbol mark "x" denotes that the scanning does not reach part of the character while the y coordinates become 10.

Likewise, the mosaic image is scanned from the respective points on a y-axis 320 to a direction in which the x coordinates are increased. Thus, there is tabulated a table indicative of the association between the y coordinates and the x coordinates, as shown in the following Table 3.

TABLE 3

| y | 0 | 1 | 2 | 3 | 4 | 5 | 6 | 7 | 8 | 9 | 10 |
|---|---|---|---|---|---|---|---|---|---|---|---|
| x | x | x | x | 5 | 4 | 3 | 6 | 5 | 3 | x | x |

In Table 3, the symbol mark "x" denotes that the scanning does not reach part of the character while the x coordinates become 10.

The dictionary data storage unit 106 shown in FIG. 1 stores therein the character tables as standards for recognition of various types of characters, as mentioned above. These character tables include tables associated with the scan involved in a direction in which the y coordinates are increased from the respective points on the x-axis 310, the scan involved in a direction in which the x coordinates are increased from the respective points on the y-axis 320, the scan involved in a direction in which the y coordinates are decreased from the respective points on the line 330 representative of y=10, and the scan involved in a direction in which the x coordinates are decreased from the respective points on the line 340 representative of x=10, respectively. First, of those tables, the tables associated with the scan involved in a direction in which the y coordinates are increased from the respective points on the x-axis 310, and the scan involved in a direction in which the x coordinates are increased from the respective points on the y-axis 320 are compared with the tables shown in Table 2 and Table 3, respectively. When the character is specified through the comparison, it means that the character is recognized.

In the event that the character is not specified through the comparison of the tables shown in Table 2 and Table 3 with the character tables, the scan involved in a direction in which the y coordinates are decreased from the respective points on the line 330 representative of y=10, and the scan involved in a direction in which the x coordinates are decreased from the respective points on the line 340 representative of x=10 are performed to tabulate the tables similar to the tables shown in Table 2 and Table 3. These tables thus tabulated are compared with the tables associated with the scan involved in a direction in which the y coordinates are decreased from the respective points on the line 330 representative of y=10, and the scan involved in a direction in which the x coordinates are decreased from the respective points on the line 340 representative of x=10, respectively. When the character is specified through this comparison, it also means that the character is recognized. In the event that the character is not specified through this comparison, it means that it is recognized that no character is recorded.

After the character recognition of the mosaic image represented by a character of data portion terminates, a character recognition is performed on the basis of the successive one character of data portion, whereby two paper money numbers are recognized.

After the above-mentioned character recognition is carried out in the step S114, the process goes to a step S115 in which the character decision unit decides whether the two paper money numbers recognized in the step S114 are the paper money numbers in which the mutually same characters are arranged in the mutually same sequence. In the step S115, when it is decided that the character decision unit decides that the two paper money numbers recognized in the step S114 are not the paper money numbers in which the mutually same characters are arranged in the mutually same sequence, the process goes to a step S116 in which the paper money is decided as the different number bill, and the process goes to the step S117. In the step S115, when it is decided that the character decision unit decides that the two paper money numbers recognized in the step S114 are the paper money numbers in which the mutually same characters are arranged in the mutually same sequence, the process goes to the step S117.

In the step S117, the synthetic decision unit 110 shown in FIG. 1 reads from the control unit 104 the computed values as to the slant and the passage velocity of the paper money, and decides whether the paper money is to be treated as the proper paper money, on the basis of the computed values and the above-mentioned various types of decision results, and a result of the decision and a decision result of money sort, etc. are stored in the decision result storage unit 111. Thus, the discrimination of the paper money is terminated.

Thus, as mentioned above, according to the paper discriminating apparatus of the present embodiment, two paper money numbers recorded on the paper money are recognized to decide an identity of the two paper money numbers. This feature makes it possible to discriminate the different number bill, so that the ATM into which the paper discriminating apparatus of the present embodiment is incorporated can eject the different number bill in accordance with the discrimination result.

Thus, as mentioned above, according to the paper discriminating apparatus of the present invention, it is possible to discriminate the different number bills.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. A paper discriminating apparatus wherein a paper, in which character strings inherent for each paper are recorded on a plurality of character areas on each paper, is detected so that the paper is discriminated in accordance with image data obtained by detection of the paper, said paper discriminating apparatus comprising:

a character sensor reading the plurality of character areas of the paper in the form of an image;

a character recognition unit recognizing characters of the character strings recorded on the plurality of character areas in accordance with image data obtained by said character sensor; and a character decision unit deciding a similarity between the character strings recorded on the plurality of character areas, by performing a character-by-character comparison between the characters of the character strings to determine whether the character strings have the same characters arranged in the same order.

2. A paper discriminating apparatus according to claim 1, wherein said character decision unit decides whether the character strings recorded on the plurality of character areas, the character stings being recognized by said character recognition unit, are character stings in which mutually same characters are arranged in mutually same sequence.

3. A paper discriminating apparatus according to claim 1, wherein said image sensor being lower in resolution than said character sensor.

4. A paper discriminating apparatus according to claim 1, further comprising a paper discriminating unit for discriminating a sort of the paper in accordance with the image data obtained by said image sensor, wherein said character recognition unit recognizes a character recorded on the character areas according to the sort of paper decided in said paper discrimination unit.

5. An apparatus for authenticating a document, comprising:

a character sensor reading character strings inherent for each document on a plurality of character areas on the document; and a character decision unit comparing the character strings of the document to one another and deciding whether the character strings are similar by performing a character-by-character comparison between characters of the character strings to determine whether the character strings have the same characters arranged in the same order.

6. A method for authenticating a document, comprising:

reading character strings inherent for each document on a plurality of character areas on the document; and comparing the character strings of the document to one another and deciding whether the character strings are similar by performing a character-by-character comparison between characters of the character strings to determine whether the character strings have the same characters arranged in the same order.

* * * * *